US009028261B2

(12) United States Patent
Makinen

(10) Patent No.: US 9,028,261 B2
(45) Date of Patent: May 12, 2015

(54) SNAP ELECTRICAL CONNECTOR HAVING A CIRCUMFERENTIAL GROOVE AND PRONG INTERCONNECTION

(71) Applicant: Carol Makinen, Marysville, WA (US)

(72) Inventor: Carol Makinen, Marysville, WA (US)

(73) Assignee: Patrick Alan Watson, Marysville, WA (US)

( * ) Notice: Subject to any disclaimer, the term of this patent is extended or adjusted under 35 U.S.C. 154(b) by 115 days.

(21) Appl. No.: 13/859,585

(22) Filed: Apr. 9, 2013

(65) Prior Publication Data

US 2014/0302700 A1 Oct. 9, 2014

(51) Int. Cl.

| | |
|---|---|
| ***H01R 35/00*** | (2006.01) |
| ***H01R 13/56*** | (2006.01) |
| *H01R 13/20* | (2006.01) |

(52) U.S. Cl.

CPC ..... *H01R 35/00* (2013.01); *H01R 13/20* (2013.01); *H01R 13/56* (2013.01)

(58) Field of Classification Search

CPC ..... H01R 24/50
USPC ..... 439/63, 581, 675
See application file for complete search history.

(56) References Cited

U.S. PATENT DOCUMENTS

| | | | | |
|---|---|---|---|---|
| 3,893,743 | A * | 7/1975 | Wallo | 439/578 |
| 5,147,221 | A * | 9/1992 | Cull et al. | 439/585 |
| 5,180,315 | A * | 1/1993 | Nagashima | 439/581 |
| 5,322,453 | A * | 6/1994 | Resnick et al. | 439/581 |
| 5,376,022 | A * | 12/1994 | Carr et al. | 439/668 |
| 5,556,292 | A * | 9/1996 | Kato et al. | 439/218 |
| 5,971,810 | A * | 10/1999 | Taylor | 439/675 |
| 6,074,217 | A * | 6/2000 | Maruyama et al. | 439/63 |
| 6,079,986 | A * | 6/2000 | Beshears | 439/63 |
| 6,533,617 | B1 * | 3/2003 | D'Addario | 439/669 |
| 6,568,964 | B2 * | 5/2003 | D'Addario | 439/675 |
| 6,729,912 | B2 * | 5/2004 | D'Addario | 439/675 |
| 6,981,895 | B2 * | 1/2006 | Potega | 439/578 |
| 7,341,459 | B1 * | 3/2008 | Robinette et al. | 439/53 |
| 7,425,153 | B1 * | 9/2008 | Miller | 439/578 |
| 7,736,193 | B2 * | 6/2010 | Edeler et al. | 439/675 |
| 8,628,359 | B2 * | 1/2014 | Yokoyama et al. | 439/675 |

* cited by examiner

*Primary Examiner* — Neil Abrams
(74) *Attorney, Agent, or Firm* — QuickPatents; Kevin Prince

(57) ABSTRACT

An electrical connector for selectively connecting at least a first electrical line and a second electrical line together includes an annular ring having at least one electrically-conductive circumferential groove in an outer peripheral surface, an inner surface, or both. An annular socket comprises a plurality of downwardly-projecting electrically-conductive prongs, each of which is resiliently attached at a top end thereof to an annular socket ring. Each prong terminates proximate a bottom end thereof at an electrical contact. The prongs are adapted for electrically and mechanically engaging the grooves of the annular ring. The socket may be pressed onto the ring to resiliently deform the prongs momentarily until the contact of each prong is seated into the groove of the ring. When the socket is rotated with respect to the ring electrical connectivity is maintained between the pair of electrical lines each connected to either the socket or the groove.

17 Claims, 6 Drawing Sheets

SNAP ELECTRICAL CONNECTOR HAVING A CIRCUMFERENTIAL GROOVE AND PRONG INTERCONNECTION

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to electrical connectors, and more particularly to an improved, snap connector.

DISCUSSION OF RELATED ART

Conventional audio jacks, such as those used for connecting an audio signal line to a headset, headphones, or the like, typically use a 3.5 mm pin that is inserted into a jack. In such convention connectors, the pins often break or bend because of improper insertion or retraction of the pin, or inadvertent torque force imposed on the pin at an angle with respect to the longitudinal axis of the pin.

For example, US Patent Application 2004/009702 to Potega on Jan. 15, 2004, teach a connector that has longitudinal pins that can be easily bent or damaged when any sidelong force is applied to the connector. While the device taught in U.S. Pat. No. 7,736,193 to Edeler et al. on Jun. 15, 2010, includes at least one annular connector portion which is less susceptible to damage, such a device still includes a longitudinal-type pin connector and as such suffers from many of the same drawbacks as the Potega device and conventional pin-type connectors. Likewise, US Patent Application 2003/0181099 to D'Addario on Sep. 25, 2003 has similar drawbacks.

Therefore, there is a need for a device that is a low-profile connector that resists damage when torque or sidelong forces are applied thereto as it would readily disconnect before becoming damaged. Such a needed connector would provide connectivity regardless of the relative rotational position of each part of the connector, and would be intuitive to use. Such a needed device would further provide for connecting any number of electrical line pairs. The present invention accomplishes these objectives.

SUMMARY OF THE INVENTION

The present device is an electrical connector for selectively connecting at least a first electrical line and a second electrical line together. For example, such a connector may be used to connect an electrical device to a power source, or an audio-transducer such as a pair of headphones to an electronic audio source, or the like.

An annular ring has an outer peripheral surface, an inner surface, a top surface, and a bottom surface. Either the outer or the inner surface, or both, includes an electrically-conductive circumferential groove that is electrically connected with a first electrical line. An annular socket comprises a plurality of downwardly-projecting electrically-conductive prongs, each of which is resiliently attached at a top end thereof to an annular socket ring. Each prong terminates proximate a bottom end thereof at an electrical contact. The prongs are adapted for electrically and mechanically engaging the groove of the annular ring, and the electrical contacts are each electrically connected to the second electrical line.

In use, when the socket is longitudinally aligned with the ring, the socket may be pressed into the ring to resiliently deform the prongs momentarily until the contact of each prong is seated into the groove of the ring. As such, the first and second electrical lines are electrically connected while the prongs mechanically retain the socket rotationally onto the ring. When the socket is rotated with respect to the ring electrical connectivity is maintained between the pair of electrical lines. Upon pulling the socket away from the ring, each prong momentarily deforms away from the ring to mechanically release the socket from the ring and break the electrical connection between the at least two electrical lines. Preferably the electrical contact of each prong is a pointed or rounded portion of the bottom end of the prong.

The annular ring may include two or more electrically-conductive grooves in a stacked configuration, each groove being a unique distance from the ring mounting board, on the inner surface of the ring, the outer surface of the ring, or both, all electrically mutually isolated with a non-conductive ring insulator. Likewise, the annular socket in such an embodiment includes a plurality of sets of downwardly-projecting prongs. The prongs of a lower set extend downwardly past the prongs of an upper set of prongs and are adapted to engage the lower inner groove of the annular ring, for example. Other sets of prongs are adapted to engage the other grooves of the ring at the different distances from the ring mounting board.

The present invention is a device that is a low-profile connector that resists damage when torque or sidelong forces are applied thereto as it readily disconnects before the prongs can become damaged. The present connector provides connectivity regardless of the relative rotational position of each part of the connector, and is intuitive and easy to use. The present device further provides for connecting any number of electrical line pairs, making it versatile for use in a wide number of applications. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
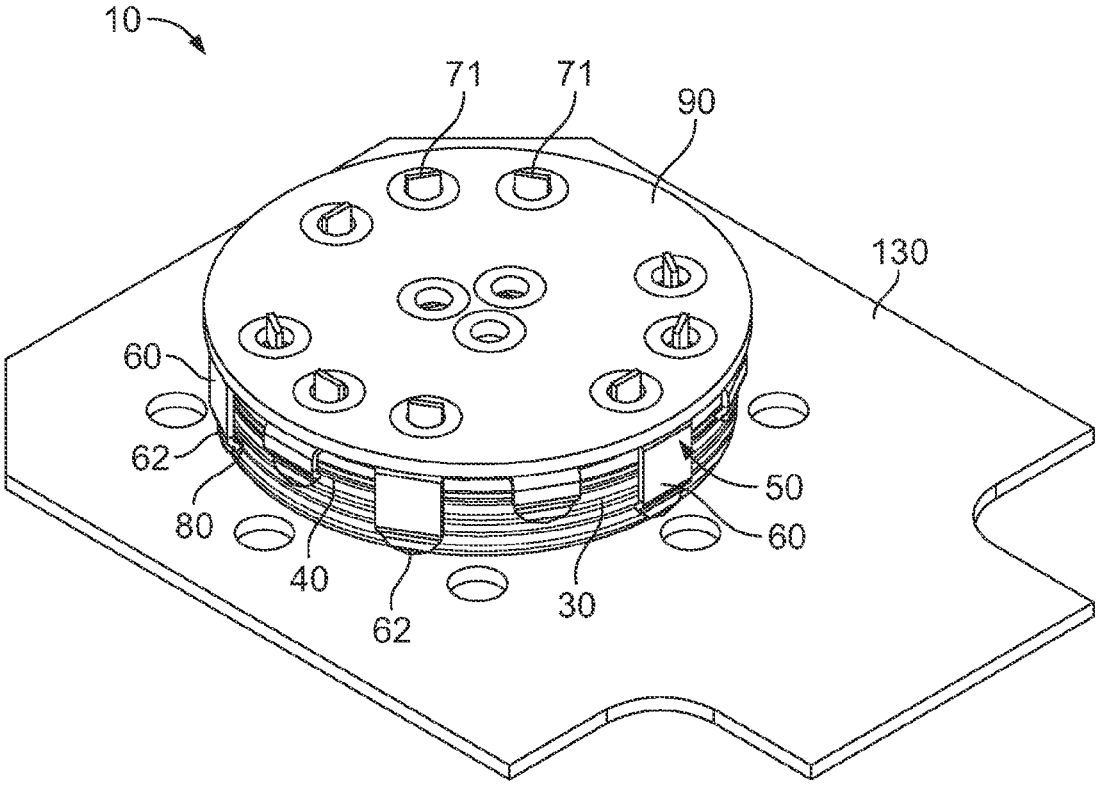
FIG. 1 is a perspective view of the invention, illustrating an annular socket thereof as engaged with an annular ring thereof.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1-4 illustrate an electrical connector 10 for selectively connecting at least a first electrical line 21 and a second electrical line 22 together. For example, such a connector 10 may be used to connect an electrical device (not shown) to a power source, or an audio-transducer such as a pair of headphones to an electronic audio source.

An annular ring 30 (FIGS. 1, 2, 4 and 6) has an outer peripheral surface 39, an inner surface 31, a top surface 38, and a bottom surface 32. Either the outer or the inner surface 39,31 includes an electrically-conductive circumferential groove 40 that is electrically connected with a first electrical line 21. The annular ring 30 may be made of an electrically-conductive metal material, for example.

An annular socket 50 (FIGS. 1-3 and 5) comprises a plurality of downwardly-projecting electrically-conductive prongs 60, each of which is resiliently attached at a top end 68 thereof to an annular socket ring 70. Each prong 60 terminates proximate a bottom end 62 thereof at an electrical contact 80. The prongs 60 are adapted for electrically and mechanically engaging the groove 40 of the annular ring 30, and the electrical contacts 80 are each electrically connected to the second electrical line 22. The prongs 60 may be made of a resilient electrically-conducting metal, for example.

In one embodiment, the outer surface 39 of the annular ring 30 includes the circumferential groove 40, and each downwardly-projecting prong 60 flexes radially outward to engage or disengage the annular ring 30. In an alternate embodiment of the invention, the inner surface 31 of the annular ring 30 includes the circumferential groove 40, and each downwardly-projecting prong 60 flexes radially inward to engage or disengage the annular ring 30. Since in either embodiment opposing prongs 60 of the socket 50 mechanically oppose each other as well, the socket 50 is retained by friction onto the ring 30 when the prongs 60 are each fully seated within the groove 40 of the ring 30.

In yet another embodiment of the invention, both the outer and inner surfaces 39,31 of the annular ring include one of the circumferential grooves 40, and the annular socket 50 comprises two sets of downwardly-projecting prongs 60, an outer set 150 of which flexes radially outward to engage or disengage the groove 40 on the outer surface 39 of the annular ring 30, and an inner set 150 of which flexes radially inward to engage or disengage the groove 40 on the inner surface 31 of the annular ring 30. As such, each groove 40 of the annular ring 30 may be electrically mutually isolated, and each set 150 of prongs 60 may also be electrically mutually isolated. As such, two pairs of electrical lines 21*a*,22*a* and 21*b*,22*b* may be separately mutually connected or disconnected by engaging or disengaging the socket 30 and the ring 50.

The connector 10 may further include a socket mounting board 90 through which at least one pin 71 electrically connected to each electrical contact 60 is fixed. As such, the socket 50 may be mechanically and electrically mounted such as with solder or other conventional means to the socket mounting board 90. Further, a non-conductive cap 100 may be fixed around the mounting board 90 and the annular socket 50 on all but a bottom side 52 of the socket 50. As such, a top surface 108 of the cap 100 may be pressed toward the annular ring 30 to engage the annular socket 50 with the annular ring 30, the cap 100 and anyone touching the cap 100 being electrically insulated from the annular socket ring 70 or at least one pin 71. Such a cap 100 may include an aperture 110 through which at least one electrical cable 120 traverses and is fixed immovably within. The connector 10 may further include a ring mounting board 130 through which at least one of the pins 71 are electrically connected to the groove 40 is fixed. A non-conductive enclosure 140 that surrounds the annular ring 30 on all but a tope side 37 thereof may further be included, as well as at least one mechanical fastener (not shown) such as a plastic snap for further securing the ring 30 to the ring mounting board 130.

In use, when the socket 50 is longitudinally aligned with the ring 30, the socket 50 may be pressed into the ring 30 to resiliently deform the prongs 60 momentarily until the contact 80 of each prong 60 is seated into the groove 40 of the ring 30. As such, the first and second electrical lines 21,22 are electrically connected while the prongs mechanically retain the socket 50 rotationally onto the ring 30. When the socket 50 is rotated with respect to the ring 30 electrical connectivity is maintained between the pair of electrical lines 21,22. As such, the socket 50 may be rotated about the ring 30 without losing electrical connectivity between the electrical lines 21,22. Upon pulling the socket 50 away from the ring 30, each prong 60 momentarily deforms away from the ring 30 to mechanically release the socket 50 from the ring 30 and break the electrical connection between the at least two electrical lines 21,22. Preferably the electrical contact 80 of each prong 60 is a pointed or rounded portion of the bottom end 62 of the prong 60.

Figure 2:
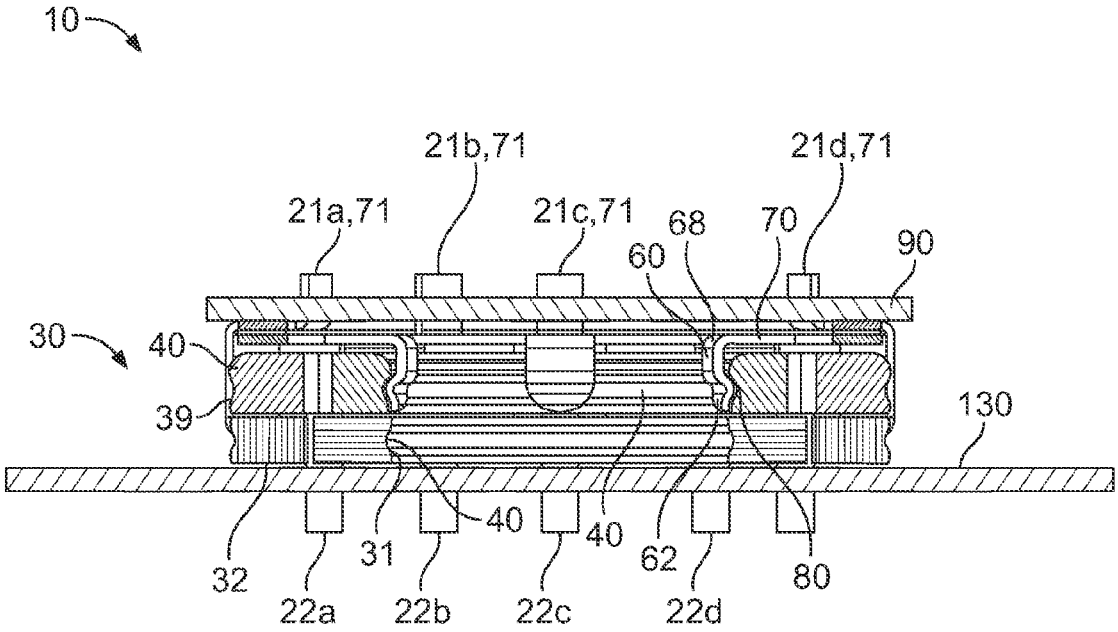
FIG. 2 is a cross-sectional view thereof, taken along the diameter of the annular socket and ring.
Figure 3:
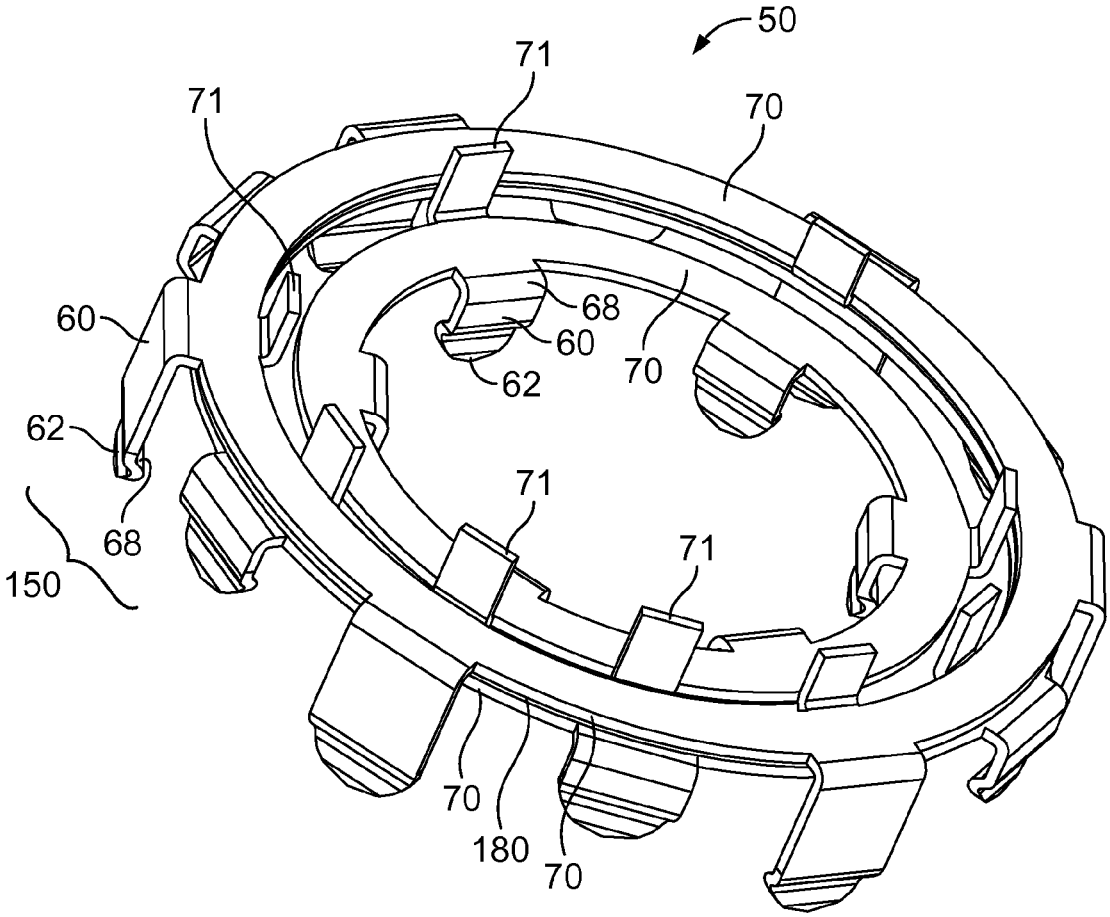
FIG. 3 is a top perspective view of the annular socket of the invention.
Figure 4:
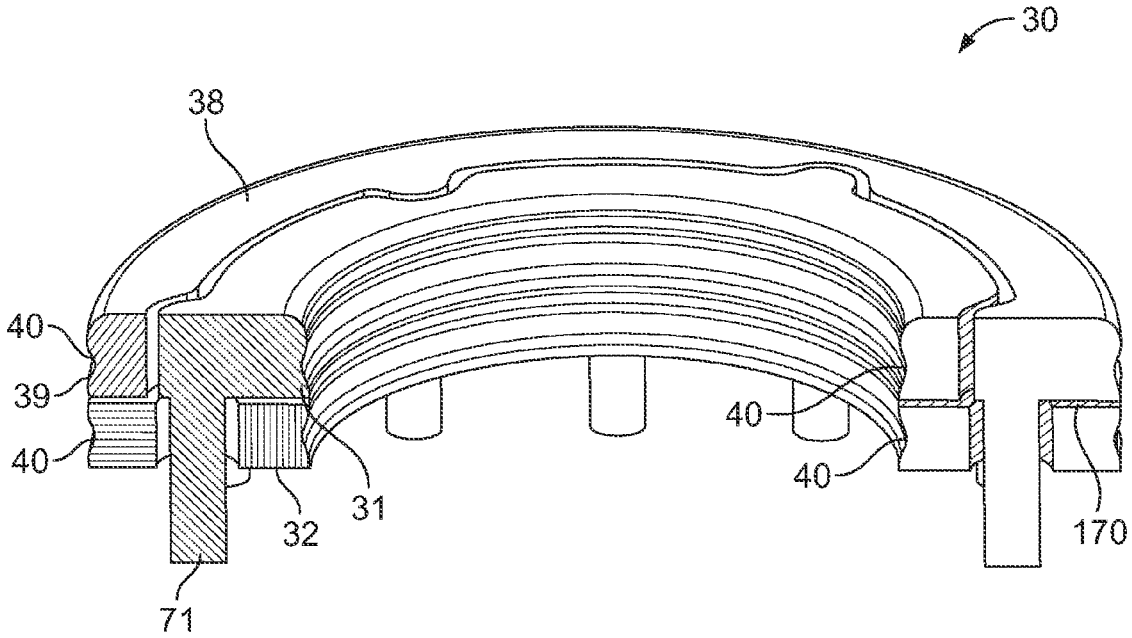
FIG. 4 is a perspective cross-sectional view of the annular ring of FIG. 2.
Figure 5:
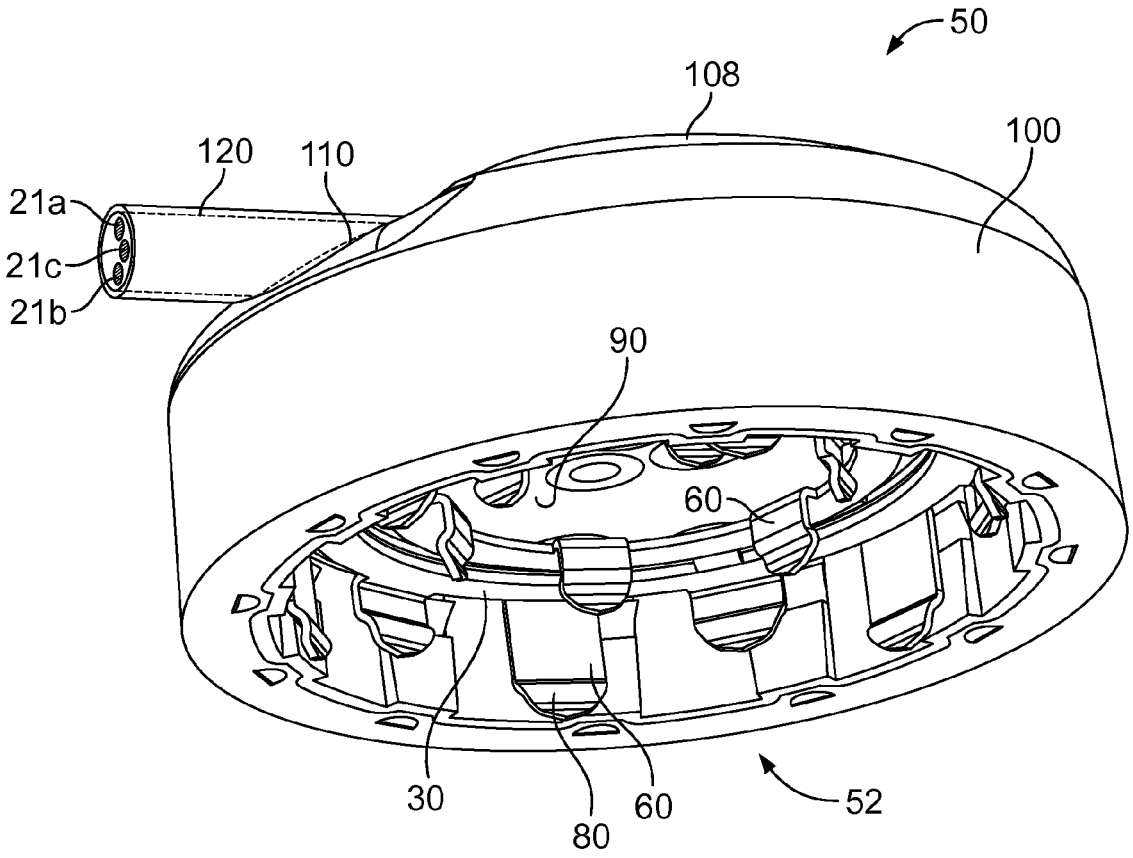
FIG. 5 is a bottom perspective view of the annular socket and further including an enclosing cap.

In one embodiment, illustrated in FIG. 2, the annular ring 30 includes four electrically-conductive grooves 40 in a stacked configuration, each groove 40 being a unique distance from the ring mounting board 130, two grooves 40 both on the inner surface 31 and the outer surface 39, and all electrically mutually isolated with a non-conductive ring insulator 170. Preferably such an insulator 170 is thicker than each contact 80 of the prongs 60 so that adjacent grooves 40 are not momentarily connected together when the contacts 80 pass from one groove 40 to the next in the stack.

Likewise, the annular socket 50 in such an embodiment includes four sets 150 of downwardly-projecting prongs, two inner sets 150 and two outer sets 150. The prongs 60 of a lower inner set extend downwardly past the prongs 60 of an upper inner set 150 of prongs 60 and are adapted to engage the lower inner groove 40 of the annular ring 30. Likewise, the prongs 60 of a lower outer set 150 extend downwardly past the prongs 60 of an upper outer set of prongs 60 and are adapted to engage the lower outer groove 40 of the annular ring 30. The upper sets 150 of prongs 60 are adapted to engage an upper groove 40 of the ring 30. Each set 150 of prongs 60 is electrically isolated from each other set 150 of prongs 60 with at least one non-conductive socket insulator 180. As such, when the socket 50 is fully engaged with the ring 30, electrical line 21*a* is only connected to electrical line 22*a*, electrical line 21*b* is only connected to electrical line 22*b*, electrical line 21*c* is only connected to electrical line 22*c*, and electrical line 21*d* is only connected to electrical line 22*d*.

In this manner any number of stacked grooves 40 and sets 150 of prongs 60 could be utilized to connect any number of pairs of electrical lines 21,22. Care must be taken that momentary electrical conductivity between different sets of the electrical lines 21,22 will not damage the circuit or circuits for which the connector is used as the prongs 60 pass downwardly through the stack of groove 40 towards their designated groove 40. For example, if line 21*a* is to be connected with line 22*a*, and line 21*b* is to be connected with line 22*b*, it may be that as line 21*a* passes the groove 40 associated with line 22*b* that line 21*a* is momentarily connected with line 22*b*, and thus choosing which lines are placed adjacent to each other in the connector 10 is an important consideration.

Figure 6:
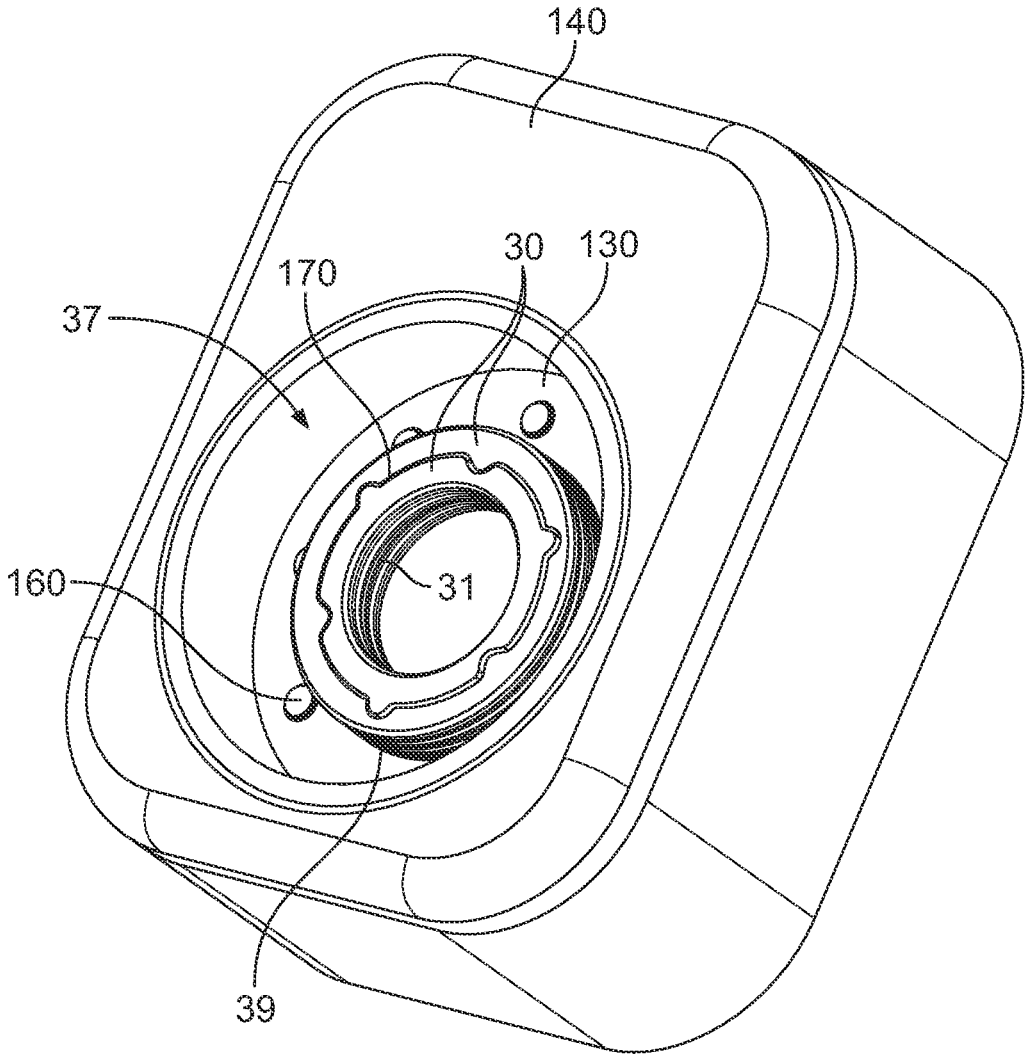
FIG. 6 is a top perspective view of the annular ring and further including an enclosure therefore.

In one embodiment, the cap 100, enclosure 140, each optionally each ring insulator 170 are made from a light-conducting electrically-insulating plastic material, or the like, that may conduct light from an LED or other light source 160 (FIG. 6). Likewise, each socket insulator 180 may be similarly manufactured, so that, for instance, connector rings 30 and sockets 50 of a similar illuminated color may be readily identified. For example, stereo headphones (not shown) may have four electrical lines to connect with four corresponding stereo output lines of an audio source. The connector 10 for such an application may utilize a particular color, such as blue wherein the cap 100 is made of a blue plastic, and the ring 30 may include a blue light source 160 so that the user knows to match the colors. Mono-channel audio connectors 10 may be red, for example, to distinguish them from the stereo connectors.

While a particular form of the invention has been illustrated and described, it will be apparent that various modifications can be made without departing from the spirit and scope of the invention. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An electrical connector for connecting a pair of electrical lines together, comprising:

an annular ring having an outer peripheral surface, an inner surface, a top surface, and a bottom surface, either the outer or inner surface including an electrically-conductive circumferential groove electrically connected with a first of the electrical lines;

an annular socket comprising a plurality of downwardly-projecting electrically-conductive prongs, each resiliently attached at a top end thereof to an annular socket ring and terminating proximate a bottom end thereof at an electrical contact, the prongs adapted for electrically and mechanically engaging the groove of the annular ring, the electrical contacts being electrically connected to a second of the electrical lines;

both the outer and inner surface of the annular ring including one of the circumferential grooves, and the annular socket comprising two sets of downwardly-projecting prongs, an outer set of which flexes radially outward to engage or disengage the groove on the outer surface of the annular ring, and an inner set of which flexes radially inward to engage or disengage the groove on the inner surface of the annular ring;

whereby when the socket is longitudinally aligned with the ring, the socket may be pressed into the ring to resiliently deform the prongs momentarily until the contact of each prong is seated into the groove of the ring, thereby electrically connecting the pair of electrical lines together and mechanically retaining the socket rotationally onto the ring, rotational movement of the socket about the ring maintaining the electrical connectivity between the pair of electrical lines, and whereby when the socket is pulled away from the ring each prong momentarily deforms away from the ring to mechanically release the socket form the ring and break the electrical connection between the at least two electrical lines.

2. The electrical connector of claim 1 further including a socket mounting board through which at least one pin electrically connected to each electrical contact is fixed.

3. The electrical connector of claim 2 further including a non-conductive cap surrounding the mounting board and annular socket on all but a bottom side thereof, whereby a top surface of the cap may be pressed towards the annular ring to engage the annular socket with the annular ring.

4. The electrical connector of claim 3 wherein the cap includes an aperture through which at least one electrical cable may traverse and be fixed immovably within.

5. The electrical connector of claim 1 further including a ring mounting board through which at least one pin electrically connected to the groove is fixed.

6. The electrical connector of claim 5 including a non-conductive enclosure surrounding at least the annular ring on all but a top side thereof.

7. An electrical connector for connecting a plurality of pairs of electrical lines together, comprising:

an annular ring having an outer peripheral surface, an inner surface, a top surface, and a bottom surface, the outer and inner surfaces including between them a plurality of electrically-conductive circumferential grooves each electrically connected with a first electrical line of each pair of electrical lines, each groove being mutually electrically isolated;

an annular socket comprising a plurality of sets of downwardly-projecting electrically-conductive prongs, each prong resiliently attached at a top end thereof to an annular socket ring and terminating proximate a bottom end thereof at an electrical contact, the prongs adapted for electrically and mechanically engaging one of the grooves of the annular ring, the electrical contacts of each set of prongs each being electrically connected to a second electrical line of each pair of electrical lines, each set of prongs being mutually electrically isolated;

whereby when the socket is longitudinally aligned with the ring, the socket may be pressed into the ring to resiliently deform each prong momentarily until the contact of each prong is seated into one of the grooves of the ring, thereby electrically connecting each electrical line of each pair of electrical lines together and mechanically retaining the socket rotationally onto the ring, rotational movement of the socket about the ring maintaining the electrical connectivity between the pairs of electrical lines, and whereby when the socket is pulled away from the ring each prong momentarily deforms away from the ring to mechanically release the socket form the ring and break the electrical connection between each pair of electrical lines.

8. The electrical connector of claim 7 wherein the outer surface of the annular ring includes the plurality of circumferential grooves, and wherein each set of downwardly-projecting prongs flexes radially outward to engage or disengage the annular ring.

9. The electrical connector of claim 7 wherein the inner surface of the annular ring includes the plurality of circumferential grooves, and wherein each set of downwardly-projecting prongs flexes radially inward to engage or disengage the annular ring.

10. The electrical connector of claim 7 wherein both the outer and inner surface of the annular ring includes one of the circumferential grooves, and wherein the annular socket comprises at least two sets of downwardly-projecting prongs, an outer set of which flexes radially outward to engage or disengage the groove on the outer surface of the annular ring, and an inner set of which flexes radially inward to engage or disengage the groove on the inner surface of the annular ring.

11. The electrical connector of claim 7 further including a socket mounting board through which at least one pin electrically connected to each set of prongs is fixed.

12. The electrical connector of claim 11 further including a non-conductive cap surrounding the mounting board and annular socket on all but a bottom side thereof, whereby a top surface of the cap may be pressed towards the annular ring to engage the annular socket with the annular ring.

13. The electrical connector of claim 12 wherein the cap includes an aperture through which at least one electrical cable may traverse and be fixed immovably within.

14. The electrical connector of claim 7 further including a ring mounting board through which at least one pin electrically connected with each groove is fixed.

15. The electrical connector of claim 14 including a non-conductive enclosure surrounding at least the annular ring on all but a top side thereof.

16. The electrical connector of claim 14 wherein the bottom surface of the ring is adapted for mounting to the ring mounting board with at least one mechanical fastener.

17. The electrical connector of claim 7 wherein each groove is electrically isolated from each other groove with at least one non-conductive ring insulator, and wherein each set of prongs is electrically isolated from each other set of prongs with at least one non-conductive socket insulator.

* * * * *